United States Patent [19]

Hirai

[11] 3,943,318

[45] Mar. 9, 1976

[54] MICROWAVE OVEN WITH TRIANGULAR OBSERVATION WINDOW

[75] Inventor: Kazumi Hirai, Nabari, Japan

[73] Assignee: Matsushita Electric Industrial Co., Ltd., Kadoma, Japan

[22] Filed: Feb. 24, 1975

[21] Appl. No.: 552,146

[30] Foreign Application Priority Data

Feb. 28, 1974 Japan ..... 49-24466

[52] U.S. Cl. ..... 219/10.55 D; 126/190

[51] Int. Cl.[2] ..... H05B 9/06

[58] Field of Search 219/10.55 D, 10.55 R, 10.55 E; 126/190, 191, 192, 193, 194

[56] References Cited

UNITED STATES PATENTS

| | | | |
|---|---|---|---|
| 3,484,573 | 12/1969 | Tingley | 219/10.55 D |
| 3,534,676 | 10/1970 | Rubino | 219/10.55 R |
| 3,756,219 | 9/1973 | Snyder | 126/191 |

*Primary Examiner*—Arthur T. Grimley

*Attorney, Agent, or Firm*—Wenderoth, Lind & Ponack

[57] ABSTRACT

A microwave oven comprising a cubical casing with front edges of its side walls cut diagonally at an angle and with its top wall made much shorter than the lower wall for hingedly supporting a door slantwise at the front edge of the top wall. The door is provided with a see-through observation window of triangular cross section projecting outwardly from its surface, so that the inner surface of the window forms part of the heating room together with the casing upon closure of the door, while an object being heated in the oven is readily observed through the window from various angles during cooking without requiring any separate illuminating source.

5 Claims, 6 Drawing Figures

MICROWAVE OVEN WITH TRIANGULAR OBSERVATION WINDOW

Figure 1:
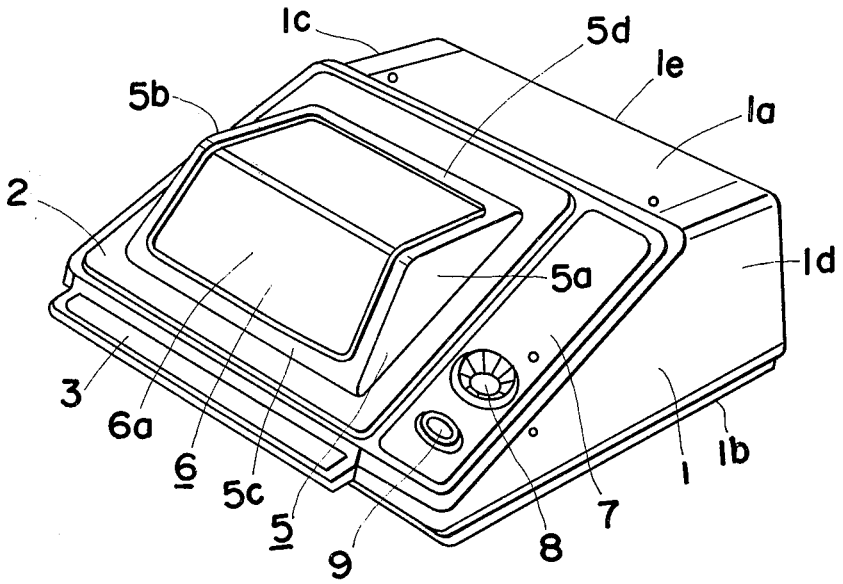

This invention relates to a microwave oven, and more particularly to a microwave oven of a type in which a door of the oven is provided with an observation window for observing an object to be heated in a heating chamber during cooking.

Conventionally, in almost all of the microwave ovens, there is provided a flat door hingedly supported at the front of the oven casing with an obervation window formed in the central portion of the door, in which arrangement, the dimension and the position of the observation window are inevitably limited.

Accordingly, in the conventional microwave oven of the above described type, only the front portion of the object to be heated in the heating chamber can be seen through the observation window, and when the door is kept closed during cooking, although the presence of the object to be cooked in noticed somehow through the observation window, the cooked condition of the object can hardly be examined. Even when the door is opened, the object being cooked which is placed inside the heating chamber can be seen only at the front portion thereof, and for fully ensuring the cooked condition of the same, the object must be taken out of the heating chamber.

In order to overcome such disadvantages, a microwave oven having a large sized door with an observation window of correspondingly large dimension and also having illuminating means incorporated therein may be considered but such a microwave oven will be so bulky and uneconomical that the same is not suitable for actual use. Furthermore, a transparent plate member to cover such a large sized observation window will unavoidably be weak against shock in opening or closure of the door and readily breakable during use.

Accordingly, an essential object of the present invention is to provide a microwave oven equipped with an observation window through which the object to be cooked in a heating chamber is readily observed during cooking without requiring separate illuminating means with substantial elimination of the disadvantages inherent in the conventional microwave ovens.

Another important object of the present invention is to provide a microwave oven of the above described type in which the observation window formed in the door defines part of the heating chamber upon closure of the door with consequent compact size of the oven casing.

A further object of the present invention is to provide a microwave oven of the above described type which is simple in construction and easy to operate, and can be manufactured at low cost.

A still further object of the present invention is to provide a microwave oven of the above described type equipped with an observation window of air tight construction which is strong against impact with consequent prolonged life.

Another object of the present invention is to provide a microwave oven of the above described type equipped with an observation window which is easy to manufacture and readily incorporated in the microwave oven.

According to a preferred embodiment of the present invention, the microwave oven comprises a cubucal outer casing comprising six walls including upper and lower walls, a rear wall, and opposite side walls defining an opening to insert an object to be cooked therethrough, and a front wall constituted by a hingedly supported door. The front edges of the side plates are cut at an angle, with the length of the upper wall reduced to about one-third of the length of the lower wall for supporting the door slantwise upon closure of the door. The door is provided with a square opening at the central portion thereof, on which opening, a triangular portion projecting outwardly from the surface of the door is formed for providing a transparent observation window which forms part of a heating chamber in the oven together with the outer casing upon closure of the door, by which arrangement, not only a large space is available in the heating chamber during operation of the oven, but the object being cooked in the heating chamber can be observed from various angles through the observation window during cooking without requiring any separate illuminating means incorporated in the oven.

Furthermore, the observation window include a transparent plate member which is composed of a transparent outer plate lined with a microwave shielding plate of punched metal or the like, and bent in the central portion thereof so as to be set in the triangular projecting portion of the frame work of the door, and a pair of transparent glass plates closely attached to the under surface of the shielding plate with the corresponding inner edges of the glass plates butted against or closely facing each other at the bent portion or an apex of the transparent outer plate, by which arrangement, bending stress to be applied to the glass plate at the bent portion is effectively absorbed, with the breakage of the glass plate advantageously prevented, and simultaneously the manufacturing cost of the transparent plate member for the observation window is markedly reduced through improved workability of the glass plates.

Figure 2:
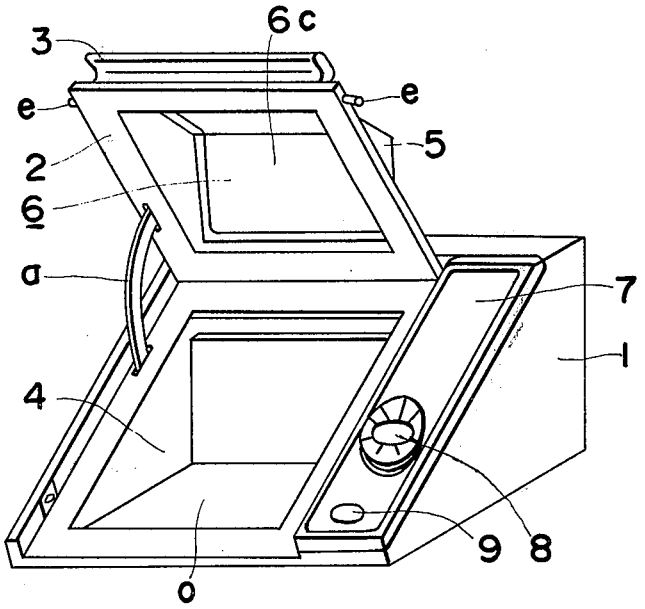
Figure 4:
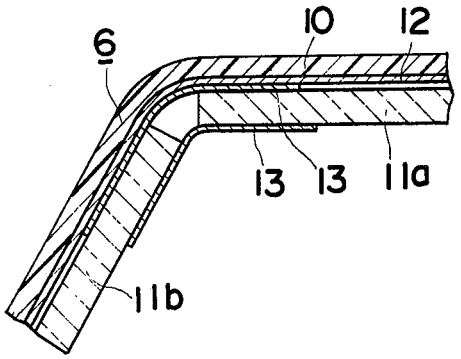
Figure 3:
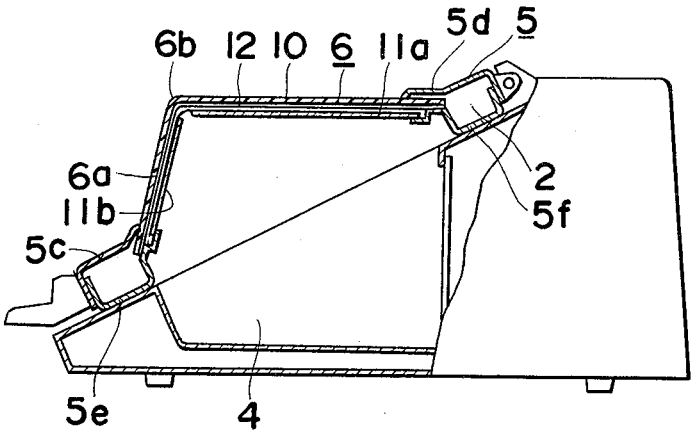
Figure 5:
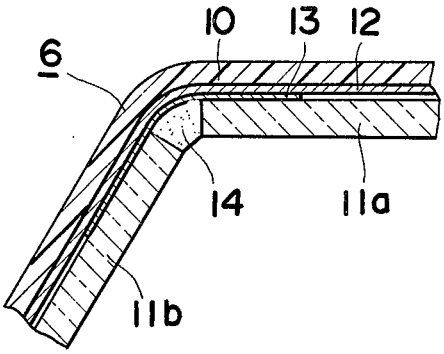
Figure 6:
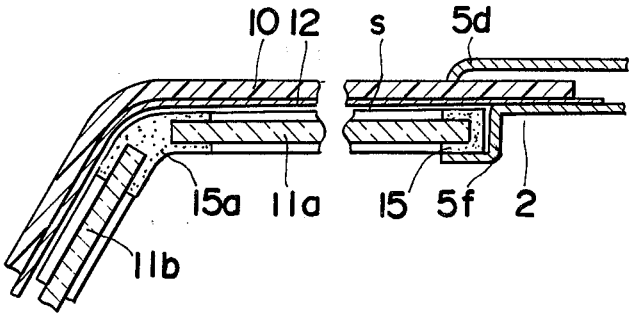

These and other objects and features of the present invention will become apparent from the following description taken in conjunction with the preferred embodiment thereof with reference to the attached drawings, in which;

FIG. 1 is a perspective view of a microwave oven according to the present invention with a door thereof closed, FIG. 2 is a similar view to FIG. 1, but shows the state in which the door thereof is opened, FIG. 3 is a side elevational view of the microwave oven of FIG. 1, partly broken away, to show the construction of an observation window thereof according to the invention, FIG. 4 is a cross sectional view showing, on an enlarged scale, a modification of the observation window of FIG. 3, FIG. 5 is a cross sectional view showing, on an enlarged scale, another modification of the observation window of FIG. 3, and FIG. 6 is a cross sectional view showing, on an enlarged scale, a further modification of the observation window of FIG. 3.

Before the description of the present invention proceeds, it is to be noted that like parts are designated by like numerals throughout several views of the accompanying drawings.

Referring to FIGS. 1 and 2, the microwave oven of the invention, which comprises a cubical outer casing structure 1 formed with six walls including upper and lower walls 1*a* and 1*b*, a rear wall 1*e*, opposite side walls 1*c* and 1*d*, and a front wall constituted by a door 2 hingedly connected to the front edge of the upper wall 1*a* of the outer casing 1 so as to be pivotable about the hinge axis upwardly or downwardly for selectively opening and closing an opening 0 defined by the walls 1*a* to 1*e*. Each of the side walls 1*c* and 1*d* is cut at an angle, at the front edge thereof, with the length of the upper wall 1*a* reduced to approximately one-third of the length of the lower wall 1*b*, so that the front wall of the casing 1 constituted by the door 2 extends slantwise downwardly from the upper wall 1*a* upon closure of the door 2. As is seen in FIG. 2, the casing structure 1 defines one of the halves of a heating chamber 4 and the door 2 formed with an outwardly extending cavity 6*c* defines the other of said halves of said heating chamber. As will be described later, when the door 2 is closed, the cavity 6*c* and the interior 4 of the casing structure in cooperation therewith defines a complete heating chamber of substantially cubic body.

The casing structure 1 may be of double walled structure and includes a conventional high frequency wave generator or a magnetron assembly not shown) incorporated at a suitable position in said casing structure 1 in any known manner. Although not shown for brevity, the oven is provided with conventional sealing means for preventing electric waves from leaking through the periphery of the door 2 when the door 2 is closed.

The door 2 has a handle 3 pivotally carried thereby and operatively associated with a door locking mechanism (not shown) including latches *e* operatively carried by the door 2 and movable between projected and retracted positions. The door 2 is supported in its opened position through a door support mechanism (not shown) including a curved door arm *a*.

An object to be heated (not shown) is inserted through the opening 0, when the door 1 is turned upward about the hinge axis by the handle 3, into the heating chamber 4 in the casing 1.

A control panel 7 is provided on the front wall adjacent to the opening 0, on which panel 7, control means for the oven, such as a timer 8 and a push button 9 for power source etc., is suitably mounted.

More specifically, the door 2 is in the form of a centrally opened plate and includes an observation window 6 which comprises a frame work 5 having a pair of opposed substantially triangular plates 5*a* and 5*b* connected in spaced relation to each other by means of beams 5*c* and 5*d*, and a transparent plate member 6*a* of L-shaped cross section defining the cavity 6*c* at the inner surfaces thereof and set in the frame work 5 to form said window 6 in a manner as described later.

It should be noted here that the observation window 6 of approximately L-shaped cross section thus includes two flat outer surfaces, one of which surfaces is directed in a direction approximately parallel to the surface of the upper wall 1*a* of the casing 1 and the outer of which surfaces is directed in a direction approximately normal to the surface of the lower wall 1*b* of the casing 1, so that the object being heated in the chamber 4 can be observed during cooking both through the front and upper portions of the window 6 with the inner surface 6*c* of the window 6 providing a larger space for the heating chamber 4 upon closure off the door 2.

It is also to be noted here that the door 2 including the frame work 5 of the window 6 may be integrally formed into a single unit.

The observation window 6 which directly relates to the present invention will be described in detail hereinbelow.

Referring to FIG. 3, the transparent plate member 6*a* for the observation window 6 further comprises a transparent outer plate 10 made of a plastic material, such as polycarbonate or the like and suitably bent at the central portion 6*b* thereof to fit around the edges of the triangular plates 5*a* and 5*b* and the beams 5*c* and 5*d* (FIG. 1) of the frame work 5 of the door 2, a shielding plate 12 made of punched metal or wire mesh and having the same dimension as the outer plate 10, which shielding plate 12 is closely attached to the inner surface of the outer plate 10 for shielding microwave to be radiated in the heating chamber 4, and a pair of transparent glass plates 11*a* and 11*b*, each of a size corresponding to the sizes of the front and the upper portions of the observation window 6, which glass plates 11*a* and 11*b* are further attached to the inner surface of the shielding plate 12 at the front and the upper portions of the window 6 with outer edges of the former held between the corresponding edges of the outer plate 10 and beams 5*e* and 5*f* of the frame work 5, and with the inner edges thereof butted against or closely facing each other at the bent portion 6*b* of the outer plate 10 located at the apex of a triangle defined by the triangular plates 5*a* and 5*b* of the frame work 5.

Referring now to FIG. 4 showing the cross section of the bent portion 6*b* of the observation window 6 on an enlarged scale, transparent adhesive tapes 13, for example, of polyester are applied to the upper and lower surfaces of the glass plates 11*a* and 11*b* for firmly holding the butted or closely facing inner edges of the plates 11*a* and 11*b* therebetween, although other construction of the window 6 is the same as in the embodiment of FIG. 3.

Referring to FIG. 5, there is shown another modification of the window 6 of FIG. 4. In this modification, an elastic material 14 composed of a substance having low dielectric constant, for example, of silicon is further filled in the space between the butted or closely facing inner edges of the glass plates 11*a* and 11*b* with the transparent tape 13 applied to the lower surfaces of the glass plates 11*a* and 11*b* in the modification of FIG. 4 being dispensed with. Since other construction of the window 6 is the same as that of FIG. 4, description thereof is abbreviated for brevity.

Reference is now made to FIG. 6, wherein a further modification of the embodiment of FIG. 3 is shown. In this modification, the outer and side edges of the glass plates 11*a* and 11*b* are sorrounded by an elastic member 15 of U-shaped cross section composed of a material having low dielectric constant similar to one described in the modification of FIG. 5, with the butted or closely facing inner edges of the glass plates 11*a* and 11*b* also inserted, for filling the space therebetween into corresponding U-shaped grooves which are formed in a connecting portion 15*a* integrally formed with the elastic member 15, by which arrangement, the connecting portion 15*a* of the elastic member 15 closely adheres to the inner edges of the glass plates 11*a* and 11*b*, while outer periphery off the member 15 is firmly supported by the beams 5*e* and 5*f* (FIG. 3) of the frame work 5 of the door 2, thus the door 2 being made airtight. Although the upper surface of the glass plates 11*a* and 11*b* are slightly spaced away from the lower surfaces of the shielding plate 12 in the above modification of FIG. 6, these glass plates 11*a* and 11*b* may be disposed to directly contact the shielding plate 12, or the elastic member 15 and the connecting portion 15*a* thereof may be suitably thickened to contact the shielding plate 12 with a space S kept between the shielding plate 12 and the glass plates 11*a* and 11*b*.

It is needless to say that the concept of the observation window and the construction thereof is not limited to a microwave oven, but is also applicable to any other apparatus, for example, a gas oven or an electric oven etc., wherein close observation of the object being heated or processed therein is required together with sufficient strength of the observation window against impact and consequent long life thereof.

It should also be noted that the observation window of the invention is not limited in its shape to the triangular configuration, but may be formed, for example, into a semi-circular or semi-spherical shape, or the triangular plates for the frame work may be replaced by a pair of transparent plates so long as the same serves the purpose for easily observing the object being heated or cooked in the heating chamber from various angles, with the transparent plate member for the observation window having sufficient strength against impact and shock.

As is clear from the foregoing description, in the microwave oven of the invention, since the see-through observation window is formed in the portion projecting sufficiently outwardly from the surface of the door, the inner surface of the projecting portion forms part of the heating chamber together with the casing upon closure of the door, thus contributing much to a compact size of the microwave oven. The cubical configuration of the observation window is not only advantageous in closely observing the object being heated in the heating chamber from various angles, but is very effective from the viewpoint of lighting, requiring no separate light source incorporated in the oven with consequent small power consumption.

Furthermore, since the transparent outer plate of elastic resin for the observation window of the invention is formed into an L-shaped cross section which presents a plurality of flat surfaces, workability of the same in manufacturing is much improved with good appearance when incorporated in the oven. The transparent glass plate to be attached to the inner surface of the outer plate with the shielding plate held therebetween is composed of two flat glass plates butted against or closely facing each other, at the inner edges thereof, in the position immediately below the bent portion of the outer plate, so that such flat glass plates are not only easily processed at low cost, but advantageously prevented from breakage due to bending stress concentrating upon the glass plate at the bent portion of the outer plate with such bending stress effectively absorbed at the butted portion of the glass plates. The application of the transparent tapes to the butted portion of the glass plates is particularly effective for firm connection between the glass plates and also for preventing steam from the object being heated, from entering the observation window and hindering the observation therethrough. Additionally, the elastic material filled in the space between the butted portion of the glass plates efficiently absorbs impact applied to the glass plates, while similar elastic material surrounding the outer periphery of the glass plates and also connecting the inner edges of the glass plates at the butted portion thereof serves for a combined purposes of absorbing the impact to the glass plate and of preventing steam from entering the observation window through a portion where the glass plates are attached to the frame work of the door.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. in a high frequency microwave oven, an oven forming structure comprising upper, lower, rear and side walls which define an opening, for inserting an object to be heated therethrough, into said oven structure, a front wall constituted by a hingedly supported door with the hinge axis of said door located at an upper edge of said door for selectively opening or closing said opening, said door forming a heating chamber in cooperation with said oven structure upon closure of said door, means for supplying high-frequency energy to said heating chamber, and means for sealing the door for preventing electric waves from leaking through periphery of said door upon closure thereof, said door being formed thereon with a transparent observation window including at least two flat surfaces, one of which surfaces is disposed in a direction approximately parallel to a surface of said upper wall of said oven structure and the other of which surfaces is disposed in a direction approximately normal to a surface of said lower wall of said oven structure.

2. A high frequency microwave oven as claimed in claim 1, wherein said observation window of said door further comprises an outer plate member of transparent resinous material lined with a microwave shielding plate member, a plurality of transparent flat glass plates closely attached to said outer plate member with said microwave shielding plate member held therebetween, and with neighboring edges of said glass plates butted against or closely facing each other.

3. A high frequency microwave oven as claimed in claim 2, wherein said glass plates are applied with transparent adhesive tape member, at upper and lower surfaces thereof, at said butted or facing neighboring edges of said glass plates for firmly connecting the same.

4. A high frequency microwave oven as claimed in claim 2, wherein said glass plates are applied with transparent adhesive tape member, at upper surfaces thereof, at said butted or closely facing neighboring edges of said glass plates with an elastic member of low dielectric constant disposed in space between said butted or closely facing neighboring edges of said glass plates.

5. A high frequency microwave oven as claimed in claim 2, wherein said glass plates are surrounded, at outer periphery thereof, by the elastic member with said butted or closely facing neighboring edges of said glass plates also covered with connecting portion of the elastic member integrally formed with said elastic member.

* * * * *